US009644446B2

(12) United States Patent
Bihun et al.

(10) Patent No.: US 9,644,446 B2
(45) Date of Patent: May 9, 2017

(54) BALL LAUNCHER FOR A TUBING STRING

(71) Applicant: Redco Equipment Sales Ltd., Edmonton (CA)

(72) Inventors: Nick Bihun, Nisku (CA); Steve Forberg, Edmonton (CA); Roger Wolf, Edmonton (CA)

(73) Assignee: Redco Equipment Sales Ltd., Edmonton (CA)

( * ) Notice: Subject to any disclaimer, the term of this patent is extended or adjusted under 35 U.S.C. 154(b) by 730 days.

(21) Appl. No.: 14/050,506

(22) Filed: Oct. 10, 2013

(65) Prior Publication Data

US 2015/0021011 A1 Jan. 22, 2015

(30) Foreign Application Priority Data

Jul. 18, 2013 (CA) ..... 2821324

(51) Int. Cl.

| | |
|---|---|
| ***E21B 33/06*** | (2006.01) |
| ***E21B 34/14*** | (2006.01) |
| ***E21B 33/068*** | (2006.01) |
| *E21B 33/035* | (2006.01) |

(52) U.S. Cl.

CPC ..... *E21B 33/068* (2013.01); *E21B 34/14* (2013.01); *E21B 33/0355* (2013.01)

(58) Field of Classification Search

CPC .... E21B 33/06; E21B 33/0355; E21B 33/068; E21B 34/14

USPC ..... 198/657, 672, 661, 658, 676; 241/186.5

See application file for complete search history.

(56) References Cited

U.S. PATENT DOCUMENTS

| | | | | |
|---|---|---|---|---|
| 2,961,045 A * | 11/1960 | Stogner | ..... | E21B 33/068 15/104.062 |
| 2,961,046 A * | 11/1960 | Moeller | ..... | E21B 33/068 15/104.062 |
| 4,111,334 A * | 9/1978 | Winn, Jr. | ..... | E21B 33/068 221/75 |
| 4,132,243 A * | 1/1979 | Kuus | ..... | E21B 33/068 137/268 |
| 5,205,359 A * | 4/1993 | Stephenson | ..... | E21B 43/261 166/284 |
| 7,571,773 B1 | 8/2009 | West et al. | | |

(Continued)

FOREIGN PATENT DOCUMENTS

CA 2703426 A1 11/2010

*Primary Examiner* — Blake Michener
*Assistant Examiner* — Christopher Sebesta
(74) *Attorney, Agent, or Firm* — Davis & Bujold PLLC; Michael J. Bujold

(57) ABSTRACT

A ball launcher has a body and a ball conveyor. The body has a sidewall defining axial bore, an attachment for attaching to a tubing string, and at least one radial port that provides access though the sidewall to the axial bore. The ball conveyor is carried by the body adjacent to an associated radial port. The ball conveyor comprises an inner bore in communication with the associated radial port and extends laterally outward from the body. A shaft extends along the inner bore, the shaft having a helical flight having at least one turn around the shaft, the flight and a bottom portion of the inner bore defining a ball receiving space large enough to receive a ball to be launched. A drive source rotates the shaft in a first direction to cause the flight to advance one or more balls toward the radial port.

14 Claims, 6 Drawing Sheets

(56) References Cited

U.S. PATENT DOCUMENTS

| | | | | |
|---|---|---|---|---|
| 7,976,259 | B2 * | 7/2011 | Craig | B01J 8/002 198/660 |
| 8,136,585 | B2 | 3/2012 | Cherewyk | |
| 2005/0184083 | A1 * | 8/2005 | Diaz | E21B 33/138 221/75 |
| 2010/0147866 | A1 * | 6/2010 | Witkowski | E21B 33/138 221/1 |
| 2012/0152525 | A1 * | 6/2012 | McGuire | E21B 33/068 166/193 |

* cited by examiner

BALL LAUNCHER FOR A TUBING STRING

TECHNICAL FIELD

This relates to a ball launcher used to launch balls into a tubing string during, for example, a selective fracking operation.

BACKGROUND

Fracturing operations, or fracking, are used to help stimulate an underground formation. These operations are generally accomplished by exerting fluid pressure on the formation until the formation fractures. A selective fracking operation involves applying pressure to an isolated section of the formation. Once one portion has been tracked, the fracking tool is manipulated to isolate and apply pressure to a different section of the formation. This often involves opening and closing valves using balls that are launched into the tubing by a ball launcher. Examples of ball launchers can be found in U.S. Pat. No. 7,571,773 (West et al.) entitled "Multiple Ball Launch Assemblies and Methods of Launching Multiple Balls into a Wellbore" and U.S. pregrant publication no. 2012/0152525 (McGuire et al.) entitled "Low Profile, High Capacity Ball Injector".

SUMMARY

There is provided a ball launcher, comprising a body having a sidewall defining axial bore, an attachment for attaching to a tubing string, and at least one radial port that provides access though the sidewall to the axial bore. A ball conveyor is carried by the body adjacent to an associated radial port. The ball conveyor comprises an inner bore in communication with the associated radial port and extends laterally outward from the body and a shaft that extends along the inner bore. The shaft has a helical flight having at least one turn around the shaft, the flight and a bottom portion of the inner bore defining a ball receiving space large enough to receive a ball to be launched. A drive source rotates the shaft in a first direction to cause the flight to advance one or more balls toward the radial port.

According to another aspect, the ball conveyor further comprises an access opening for inserting a ball into the inner bore.

According to another aspect, the sidewall may comprise a tapered surface at the radial port to facilitate the ball entering the axial bore.

According to another aspect, there may be a plurality of radial ports and ball conveyors spaced circumferentially about the sidewall of the body.

According to another aspect, there may be a plurality of radial ports and ball conveyors spaced axially along the sidewall of the body. There may be a plurality of radial ports and ball conveyors spaced circumferentially about the sidewall of the body and axially along the sidewall of the body.

According to another aspect, the flight may terminate outside the inner bore of the body.

According to another aspect, the flight may comprise a plurality of turns for housing a plurality of balls, wherein each revolution of the shaft corresponds with a ball entering the axial bore of the body from the inner bore of the housing.

According to another aspect, the axial bore may be unencumbered by the ball conveyor as the shaft and the flight rotate.

According to another aspect, the ball conveyor may further comprise a conveyor housing, the flight on the shaft being sealed within the housing relative to atmosphere. The drive source may be positioned outside the conveyor housing, the shaft out of the conveyor housing through a seal to engage the drive source.

According to another aspect, the drive source may be a rotary motor.

According to another aspect, the rotary motor may comprise a counter for counting rotations of the rotary motor.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
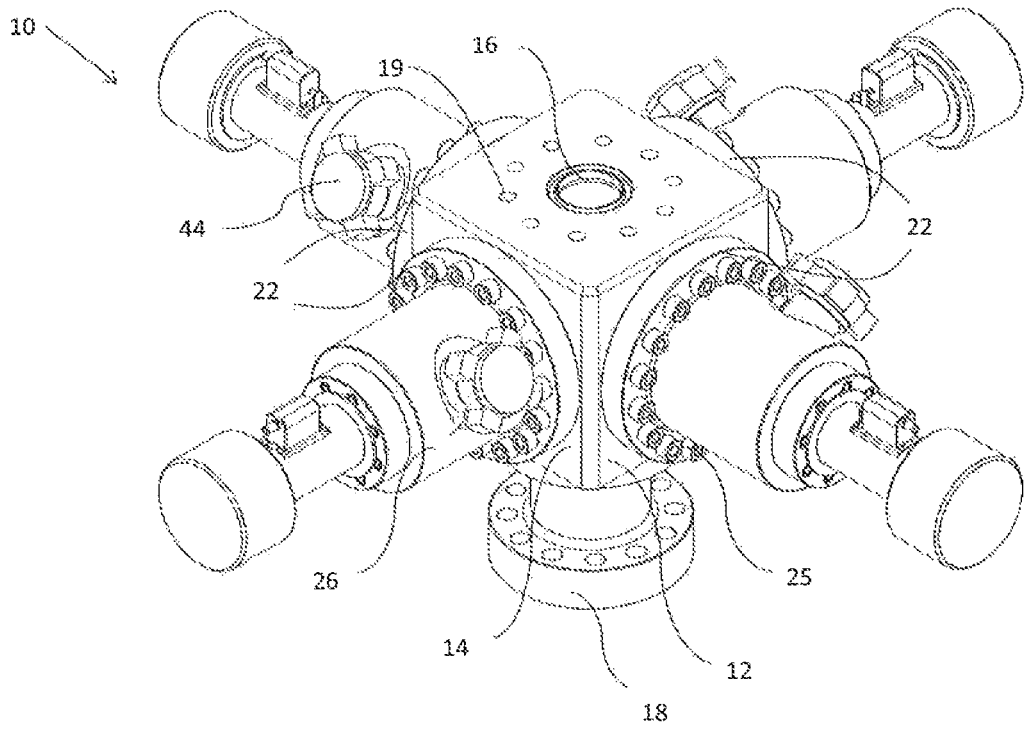
FIG. 1 is a perspective view of a ball launcher.
Figure 2:
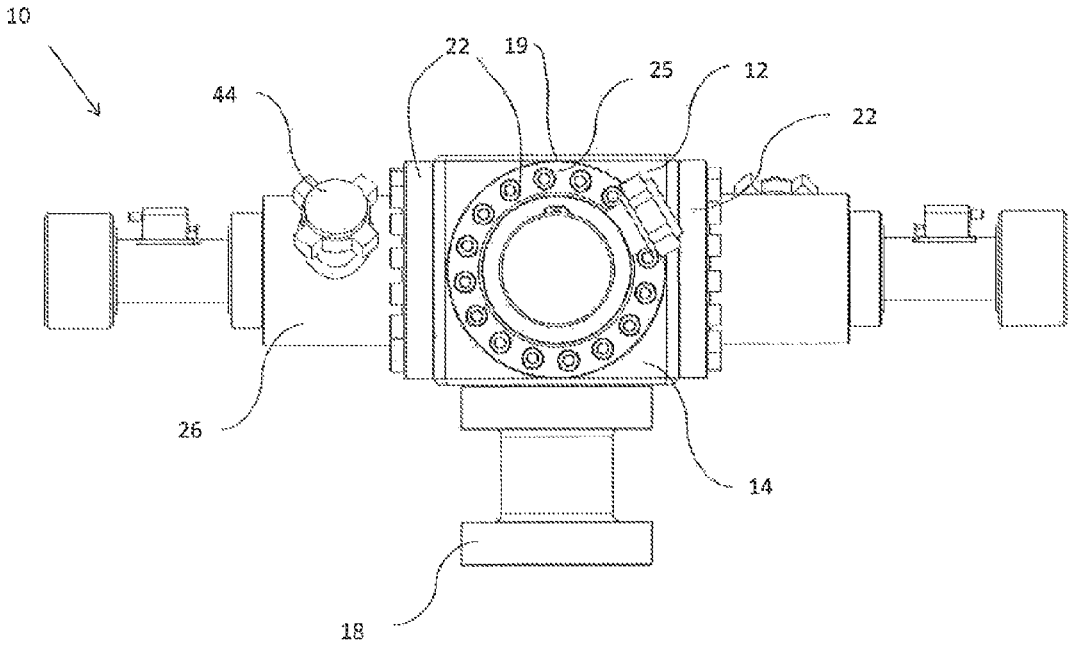
FIG. 2 is a side elevation view in section of a ball conveyor.

Referring to FIGS. 1 and 2, a ball launcher, generally identified by reference numeral 10, has a body 12 with a sidewall 14 defining axial bore 16. Body 12 is designed to be attached by an attachment 18 in line with a tubing string (not shown). The term "body" as used herein is generally used to indicate a housing or union that can be mounted inline with a tubing string or wellhead stack. As shown, body 12 is designed to be attached above ground and supported by a wellhead. Accordingly, body has a bottom attachment 18 in the form of a flange that can be attached to the wellhead or at another convenient point above ground. Body 12 also has a top attachment 19 in the form of a series of threaded holes that is designed to allow the desired equipment to be attached. Body 12 may be attached at any convenient location to permit balls to be deposited into the tubing string and will generally be located above ground. Axial bore 16 is preferably designed to be at least the same size as the axial bore of the tubing string so as not to impede the tubing string and any tools that may pass through axial bore 16. As used herein, the term "tubing" may be used to refer to any tubular body into which balls are launched and that may be inserted into a well. In particular the tubing may be casing or another type of tubing string.

Figure 3:
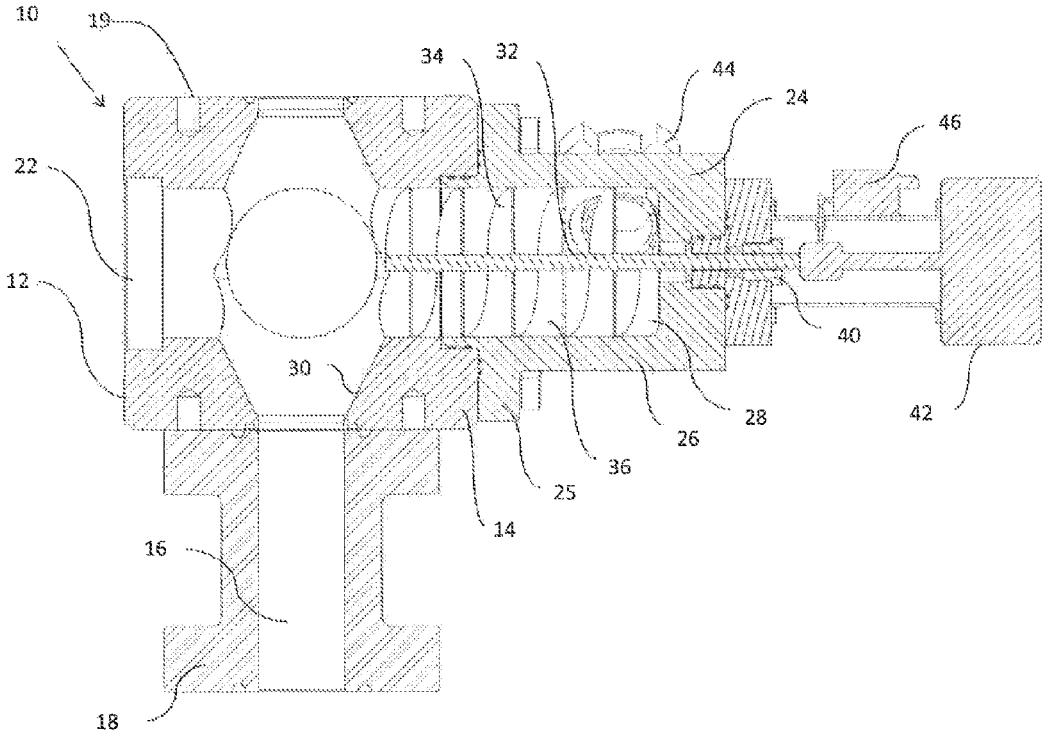
FIG. 3 is a detailed side elevation view in section of the drive source.
Figure 4:
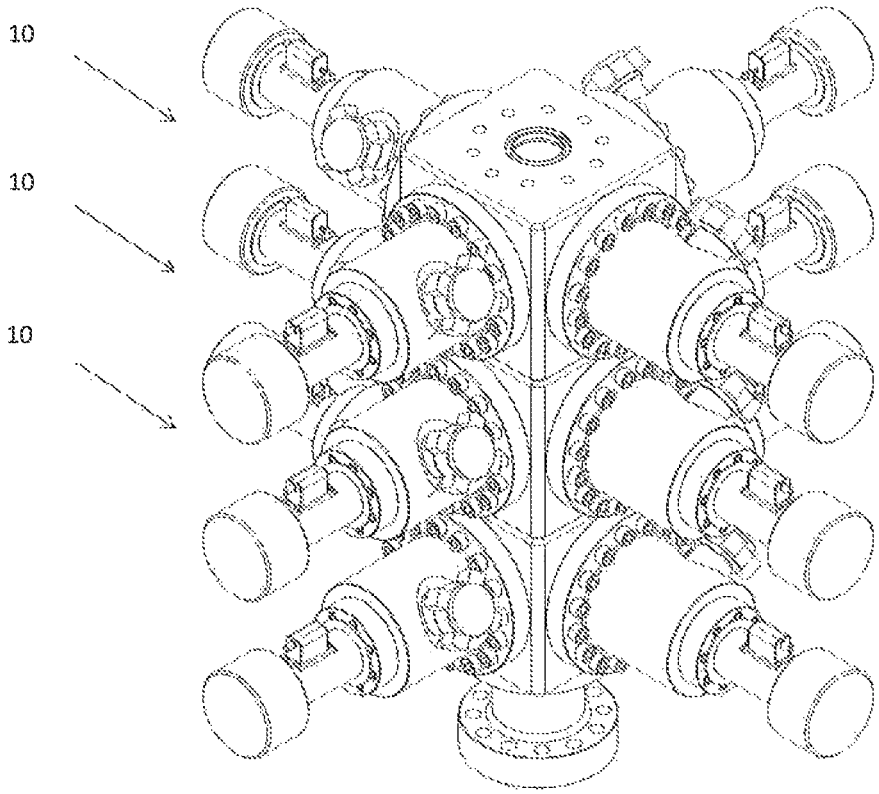
FIG. 4 is a perspective view of a stack of ball launchers.

Referring to FIG. 3, body 12 has radial ports 22 that provide access though sidewall 14 to axial bore 16. Referring to FIG. 1, there are four radial ports 22 shown spaced about the circumference of body 22. It will be understood that there may be one or more ports 22, where the number depends on the size limitations and the requirements of the intended use, including the number of balls intended to be launched. While FIG. 1 shows ports 22 spaced about the circumference of body 12, ports 22 may also be spaced axially along the height of body 12, as shown in FIG. 4. This increases the height requirements but also allows more ports 22 to be included to increase the number of balls that may be launched.

Referring now to FIG. 3, a ball conveyor 24 is carried by body 12 adjacent to each radial port 22. Ball conveyor 24 is shown as being bolted by a flange 25 to body 12, but may also be welded or otherwise attached to body 12. Bolting conveyor 24 to body 12 allows it to be more easily removed to be serviced or replaced. Ball conveyor 24 has a conveyor housing 26 defining an inner bore 28 in communication with the associated radial port 22. Inner bore 28 extends laterally outward from body 12 and radial port 22. Preferably, inner bore 28 extends horizontally or substantially horizontally out from body 12. Any angle must be insufficient to affect the operation of ball conveyor 24 as described below. As shown, radial port 22 may have a tapered surface 30 in axial bore 16, such that any balls being injected are assisted by a sloped surface to be injected into the tubing string. Multiple radial ports 22 permit multiple ball conveyors 24 to be attached. In the depicted embodiment, there are two levels of four ball conveyors 24 provided.

Figure 5:
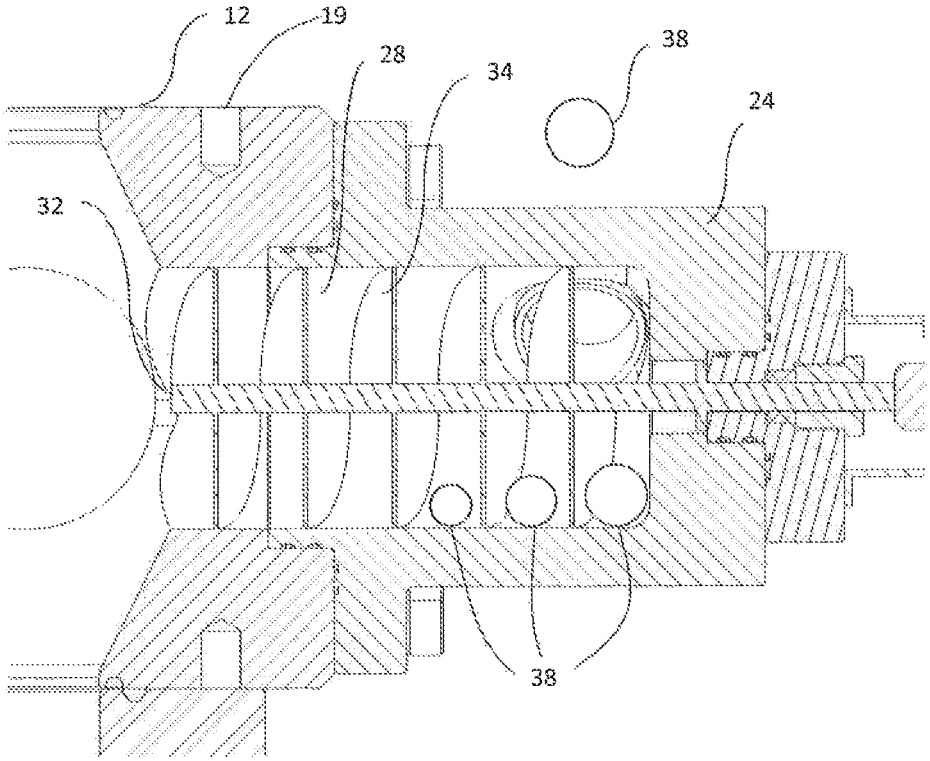
FIG. 5 is a partial view of the ball launcher shown in FIG. 3

Referring now to FIG. 2, a shaft 32 extends along inner bore 28. Shaft 32 has a helical flight 34 to form an auger or screw-type actuator. The turns of flight 34 around shaft 32 are sufficiently spaced out to define ball receiving spaces 36 within inner bore 28. The number of turns of flight 34 will correspond to the number of balls 38 to be stored. Referring to FIG. 5, there are five turns, making room for four balls 38. Flight 34 and the length of inner bore 28 may be designed to hold one or more balls 38, with the number being sufficient for the intended purpose of ball conveyor 24. While flight 34 is shown as fitting fairly closely within inner bore 28, the fit should be sufficient to ensure that flight 34 is capable of pushing ball 38 forward toward radial ports 22 and axial bore 16. Shaft 32 and flight 34 terminates at a point outside axial bore 16. As shaft 32 and flight 34 are rotated in place, they do not extend into or obstruct axial bore 16 when launching balls 38.

In order to maintain the integrity of the tubing string, conveyor housing 26 of ball conveyor 24 is attached as a sealed unit to body 12. Flight 34 is also sealed within conveyor housing 26. In the depicted embodiment, shaft 32 is also sealed within conveyor housing 26, but extends through a seal 40 out of conveyor housing 26. This allows shaft 32 to be rotated by a drive source 42, which is shown as a rotary motor. Other types of drive sources may also be used, such as a hydraulic piston that pushes and pulls on an arm to rotate shaft 32. Furthermore, other ways of maintaining a seal within conveyor housing 26 while driving shaft 32 will be apparent to those skilled in the art. For example, drive source 42 may be positioned within housing 26 with power connections (e.g. electrical or hydraulic) through conveyor housing 26.

While ball launcher 10 may be used to inject only a single ball 38, ball launcher 10 is preferably used to inject multiple balls 38. In many selective tracing tools, different sized balls are used to open particular valves in order. Accordingly, it is important to be able to inject balls 38 in order.

In the depicted example, ball conveyor 24 is loaded using an access opening 44 that allows balls 38 to be inserted between turns of flight 34. As each ball 38 is inserted, shaft 32 is rotated a full rotation until another ball 38 can be inserted into the next chamber between turns of flight 34. As drive source 42 rotates, flight 34 causes balls 38 within inner bore 28 to advance toward radial port 22. Ball conveyor 24 may have a baffle or the like (not shown) along the top or side to prevent balls from becoming stuck to flight 34 and rotating with shaft 32 rather than being pushed forward by flight 34. Drive source 42 preferably has a counter 46 that counts the rotations of shaft 32 in order to count the number of balls 38 being injected into body 12. This allows the operator to have a better idea of the order in which halls 38 are to be injected.

Referring now to FIG. 5, ball conveyor 24 is shown being loaded by balls 38. Each time a ball 38 is inserted, shaft 32 is rotated one revolution to advance the balls 38 in bore 28 and to make room for the next ball 38 to be inserted. As can be seen, smaller balls are inserted first, which corresponds to a common method of selective fracking, where balls are injected in series from smallest to largest. While only one ball conveyor 24 is depicted, it will be understood that the process may need to be coordinated with other conveyors 24 also attached to body 12 such that the balls are launched in the correct order. As cap 44 must be removed in order to load ball conveyor 24, preferably this is done when the well is depressurized or with the wellhead closed. If balls 38 are to be loaded when the well is under pressure, a two-stage valve may be used that allows hall 38 to be inserted in a space between the valves before being loaded.

Figure 6:
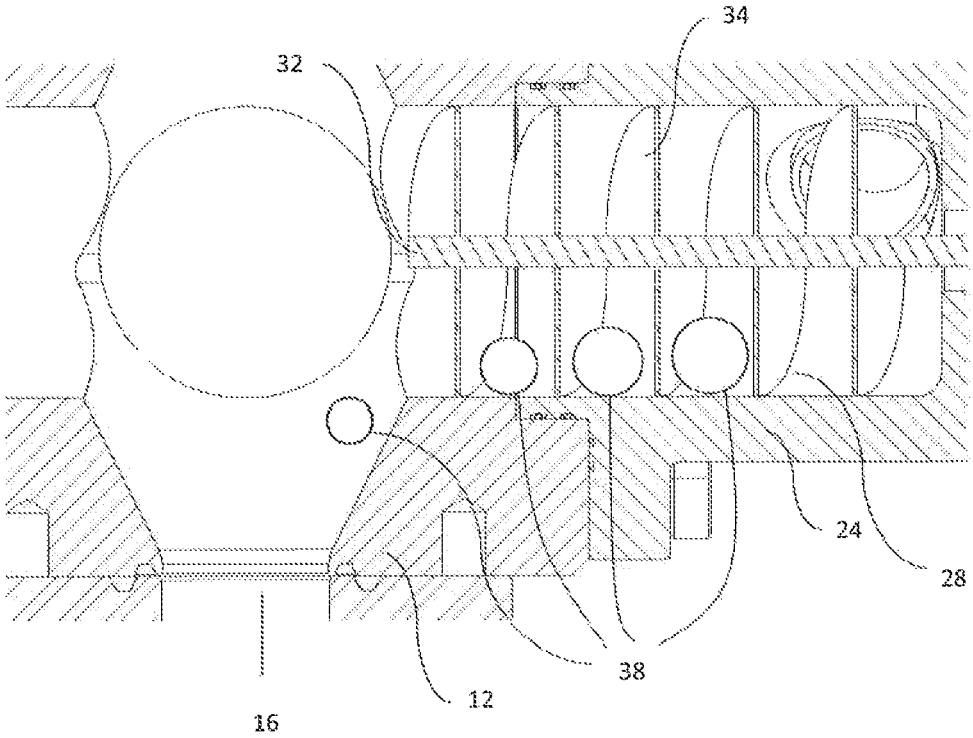
FIG. 6 is a partial view of the hall launcher shown in FIG. 3

Referring to FIG. 6, balls 38 are launched by rotating shaft 32 until ball 38 is pushed into bore 16. Because of the design of shaft 32 and flight 34, balls 38 are held in a ball receiving space and are therefore prevented from being launched until shaft 32 rotates.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A ball launcher, comprising:

a body having a sidewall defining an axial bore that extends vertically, an attachment for attaching to a tubing string; and at least one radial port that provides access though the sidewall to the axial bore;

a ball conveyor carried by the body adjacent to an associated radial port, the ball conveyor comprising:

an inner bore in communication with the associated radial port and extends horizontally outward from the body;

a helical flight that extends along the inner bore, the helical flight defining more than one turn, the helical flight and a bottom portion of the inner bore defining a plurality of ball receiving spaces large enough to receive a plurality of balls to be launched;

the plurality of balls being of different diameters and positioned within the ball receiving spaces, wherein the helical flight and the inner bore define a helical passageway that extends along the inner bore, the passageway being larger than the diameter of each of the plurality of balls; and a drive source that rotates the helical flight in a first direction to cause the helical flight to advance one or more balls toward the radial port.

2. The ball launcher of claim 1, wherein the ball conveyor further comprises an access opening for inserting the plurality of balls into the inner bore.

3. The ball launcher of claim 1, wherein the sidewall comprises a tapered surface at the radial port to facilitate the plurality of balls entering the axial bore.

4. The ball launcher of claim 1, further comprising a plurality of radial ports and ball conveyors spaced circumferentially about the sidewall of the body.

5. The ball launcher of claim 1, further comprising a plurality of radial ports and ball conveyors spaced axially along the sidewall of the body.

6. The ball launcher of claim 4, further comprising a plurality of radial ports and ball conveyors spaced circumferentially about the sidewall of the body and axially along the sidewall of the body.

7. The ball launcher of claim 1, wherein the helical flight terminates outside the inner bore of the body.

8. The ball launcher of claim 1, wherein the helical flight comprises a plurality of turns for housing the plurality of balls, wherein each revolution of the helical flight corresponds with a ball entering the axial bore of the body from the inner bore of the housing.

9. The ball launcher of claim 1, wherein the ball conveyor has an axial-bore facing end that is spaced from the axial bore such that the ball conveyor does not extend into the axial bore as the helical flight rotates.

10. The ball launcher of claim 1, wherein the ball conveyor further comprises a conveyor housing, and the helical flight being sealed within the housing relative to atmosphere.

11. The ball launcher of claim 10, wherein the drive source is positioned outside the conveyor housing and connects to the helical flight by a shaft that extends out of the conveyor housing through a seal to engage the drive source.

12. The ball launcher of claim 1, wherein the drive source is a rotary motor.

13. The ball launcher of claim 12, wherein the rotary motor comprises a counter for counting rotations of the rotary motor.

14. The ball launcher of claim 1, wherein the helical flight is mounted to a drive shaft that extends along the inner bore.

* * * * *